US006128858A

United States Patent [19]

Vetter et al.

[11] Patent Number: 6,128,858

[45] Date of Patent: Oct. 10, 2000

[54] WINDOW OPERATOR WITH LOCKING WORM DRIVE SYSTEM

[75] Inventors: Gregory J. Vetter; Perry L. Virkler, both of Owatonna, Minn.

[73] Assignee: Truth Hardware Corporation, Owatonna, Minn.

[21] Appl. No.: 09/110,515

[22] Filed: Jul. 6, 1998

[51] Int. Cl.[7] ..... E05F 11/24

[52] U.S. Cl. ..... 49/342; 49/324; 74/89.14; 74/DIG. 10

[58] Field of Search ..... 49/346, 339, 324, 49/341, 335, 337, 342, 343; 403/61, 154; 74/89.14, DIG. 10

[56] References Cited

U.S. PATENT DOCUMENTS

| | | | |
|---|---|---|---|
| 2,022,036 | 11/1935 | Haberstump | 49/324 |
| 2,214,280 | 9/1940 | Lang | 49/342 |
| 2,214,884 | 9/1940 | Kistner | 49/337 |
| 2,686,669 | 8/1954 | Johnson | 74/89.14 |
| 3,098,647 | 7/1963 | Teggelaar et al. . | |
| 3,250,038 | 5/1966 | Steel | 49/341 |
| 4,189,248 | 2/1980 | Sully . | |
| 4,209,266 | 6/1980 | Bowen et al. . | |
| 4,445,794 | 5/1984 | Sandberg | 49/324 X |
| 4,860,493 | 8/1989 | Lense | 49/341 X |
| 5,205,074 | 4/1993 | Guhl et al. | 49/324 X |
| 5,272,837 | 12/1993 | Nolte et al. . | |
| 5,493,813 | 2/1996 | Vetter et al. . | |
| 5,531,138 | 7/1996 | Vetter | 49/324 X |

FOREIGN PATENT DOCUMENTS

| | | |
|---|---|---|
| 2467954 | 4/1981 | France . |

*Primary Examiner*—Daniel P. Stodola
*Assistant Examiner*—Hugh B. Thompson
*Attorney, Agent, or Firm*—Wood, Phillips, VanSanten, Clark & Mortimer

[57] ABSTRACT

An operator for controlling the movement of a window sash relative to a frame, including a base attachable to a frame; a linkage secured to the base and attachable to a window sash to control the movement of the window sash relative to a frame; a rotatable input shaft rotatably secured to the base and driveably engaging the arm, the input shaft having a female drive region formed therein; a drive member; a transmission shaft secured on one end to the drive member and having a male drive region disposable within and mateable with the input shaft female drive region to transfer rotation of the transmission shaft to the input shaft; and means for locking the transmission shaft to one of the base and the input shaft to hold the male drive region in mateable engagement with the female drive region.

24 Claims, 10 Drawing Sheets

2
2
40
42
44
45
46
48
50
52
58
60
62
68
70
72
74
76
90
92
94
96
102

40
45
46
48
50
58
60
62
64
66
68
70
72
74
76
78
80
82
84
86
88
90
92
94
96
98
102
104
106
108

7
7
40
42
44
45
46
48
50
52
176
178
180
188
190
192
196
198
200
202
204
206
208
210
212
214
216
218
222
224
226
228
230
232
233
184
186
182
194

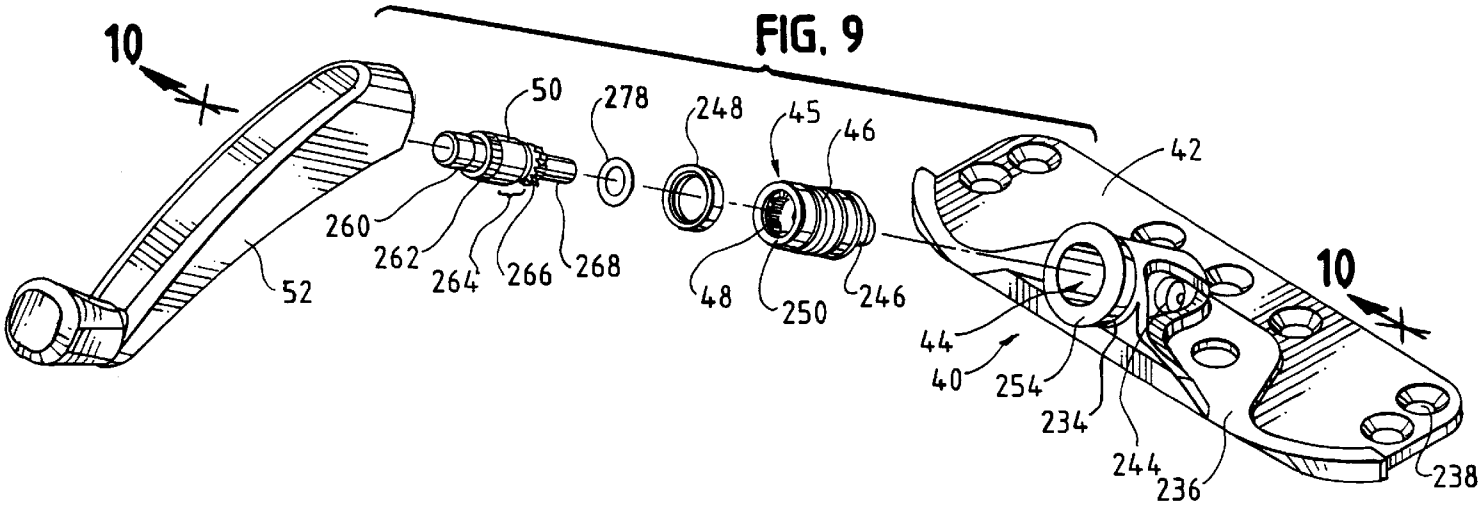
FIG. 9
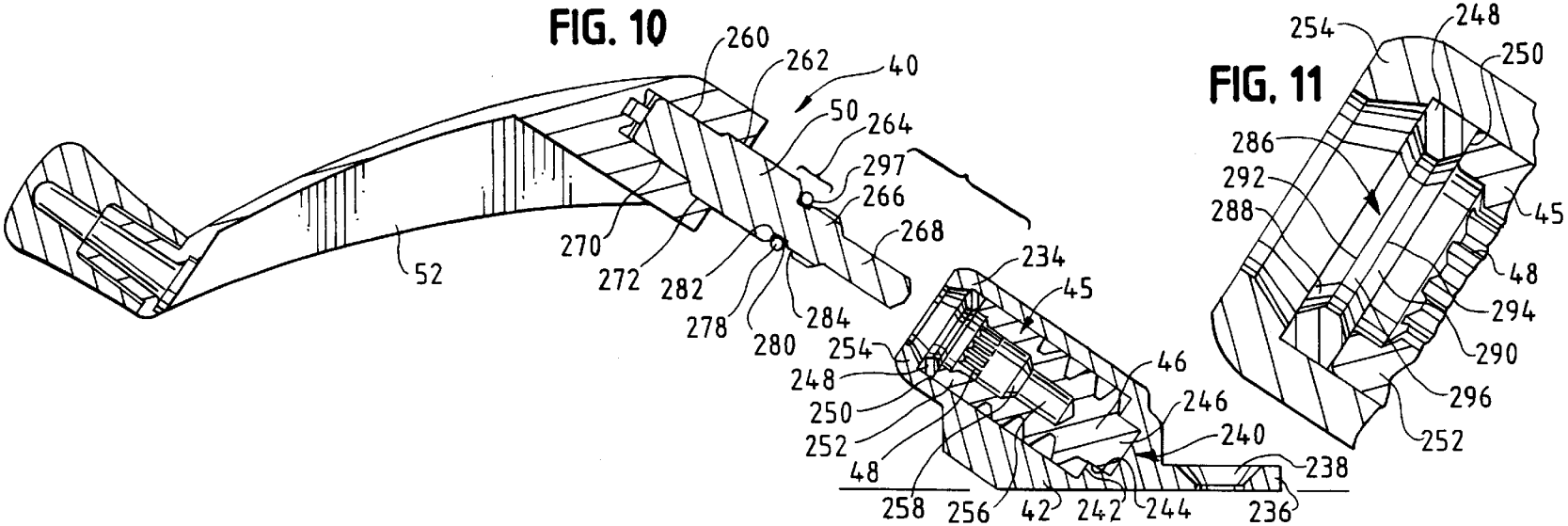
FIG. 10
FIG. 11

13
13
300
302
42
40
298
318
44
45
46
310
314
48
312
50
380
328
326
340
52
332
336
334
342
330
328
326
340
52
300
302
304
310
308
306
42
46
324
298
314
318
312
320
316
48
322
45

15
15
40
42
44
45
46
48
50
52
344
346
348
350
352
354
356
358
360
362
364
366
368
370
372
374
376
378
380
382
384
386
390
392
394
396
398
412

18
18
570
42
562
571
404
46
45
48
412
558
56
40
424
422
50
420
418
52
560
428
426
430
446
442
444
416
438
434
412
410
400
45
46
44
56
406
570
42
404
402
414
440
436
424
422
420
418
50
52

23
23
42
504
46
45
508
516
520
510
56
500
40
538
536
552
532
50
530
529
502
506
44
48
514
534
554
544
542
540
550
546
548
528
518
526
556
522
512
525
524

WINDOW OPERATOR WITH LOCKING WORM DRIVE SYSTEM

BACKGROUND OF THE INVENTION

1. Technical Field

The present invention is directed to a window operator, and in particular, to a window operator having a worm and a worm drive system that can be selectively locked to the worm.

2. Background Art

Window operators having a worm with an integrally formed worm shaft to which a handle is permanently or releasably secured are known in the art. Such integrally formed worm shafts and associated handles can be seen in U.S. Pat. Nos. 5,272,837; 4,189,248; and 4,209,266, for example. With the worm secured to the window operator, the worm shaft and associated handle conventionally extend some distance from the window operator.

It is also known in the art to secure the above-described window operators to a window to form a window assembly which is shipped to the customer who then installs the window assembly in his or her home. Because of the additional clearance required to accommodate the worm shaft (and sometimes the handle) extending from the window operator, these window assemblies are expensive to package and to ship. Additionally, the handle and worm shaft can end up damaging other windows during installation if the windows are not kept spaced from each other a proper distance, in addition to damage to the operators themselves.

It is known in the art to conceal the worm shaft by disposing it in a passage in a wall and to remotely drive the worm by a handle via a temporary coupling. French Patent No. 2,467,954 discloses a window operator having a worm with an integrally formed worm shaft which is disposed at one end of a narrow passage which extends through a wall. A coupling is provided which extends from the worm shaft to the other end of the passage, where a handle may be used to rotate the worm via this coupling.

This window operator system does not address the problems disclosed above caused by the worm shaft extending from the window assembly prior to installation, such as the expensive shipping and packaging costs involved with such assemblies, or the damage to other windows caused during installation using such windows assemblies. In addition, the window operator system disclosed requires elaborate preparatory work to be performed on the wall prior to the installation of the window operator. The window operator system also discloses that the window operator be secured to the external surface of the building, where it is exposed to environmental factors, such as precipitation and extreme temperatures.

U.S. Pat. No. 5,493,813 also discloses a temporary coupling for a handle used in conjunction with a motor-driven window operator which has an alternative manual drive to be used to open and close the window. In one embodiment of the manual drive, a worm is coupled to a handle in an operative position. However, the handle is intended to be only temporarily coupled, even in the operative position, so as to not disturb the aesthetic appearance of the window. Consequently, the forces generated in opening and closing the window using the alternative manual drive can cause the male shaft to become separated from the female worm.

Further, neither French Patent No. 2,467,954 nor U.S. Pat. No. 5,493,813 address the problems associated with conventional operators, including the stresses encountered with an angularly oriented worm (which orientation is required for proper operation so that the person does not hurt himself or the window when turning the handle by banging his hand against the window) and the necessity that the handle as connected to the operator be essentially wobble free to provide a reliable and quality feel when being turned.

The present invention is directed toward overcoming one or more of the problems discussed above.

SUMMARY OF THE INVENTION

In one aspect of the present invention, an operator is provided for controlling the movement of a window sash relative to a frame, including a base attachable to a frame; a linkage secured to the base and attachable to a window sash to control the movement of the window sash relative to a frame; a rotatable input shaft rotatably secured to the base and driveably engaging the linkage, the input shaft having a female drive region formed therein; a drive member; a transmission shaft secured on one end to the drive member and having a male drive region disposable within and mateable with the input shaft female drive region to transfer rotation of the transmission shaft to the input shaft; and means for locking the transmission shaft to one of the base and the input shaft to hold the male drive region in mateable engagement with the female drive region.

In a preferred form of this aspect of the present invention, the input shaft has a threaded worm-like end which directly driveably engages the linkage.

In another preferred form of this aspect of the present invention, the transmission shaft has a support region extending axially from the male drive region and the input shaft has a support region which extends axially into the input shaft from the female drive region, and the support region of the transmission shaft is disposed within the support region of the input shaft with the male drive region of the transmission shaft disposed in and in mateable engagement with the female drive region of the input shaft.

In yet another preferred form of the present invention, a locking plate is secured to one of the base and the input shaft, one of the transmission shaft and the locking plate having a groove formed therein, and the other of the transmission shaft and the locking plate having a radially extending edge depending therefrom, with the radially extending edge disposed within the groove to secure the transmission shaft to the base with the male drive region in mateable engagement within the female drive region. In various preferred aspects of this form of the invention, the radially extending edge is defined by a plurality of protrusions disposed within the groove to secure the transmission shaft to the base, a snap ring is secured to the transmission shaft and defines the radially extending edge, and/or the radially extending edge is formed of an elastically deformable material.

In still another preferred form of this aspect of the present invention, the base and the input shaft cooperate to define a first space in which the locking plate is at least partially disposed to secure the locking plate to one of the base and the input shaft. Further, a washer may be at least partially disposed in the first space to secure the washer to the base and cooperating with the base or the input shaft to define a second space in which the locking plate is at least partially disposed to secure the locking plate to the base or the input shaft.

In a further preferred form of this aspect of the present invention, the input shaft has a stepped region which defines a third space, the third space being at least partially within the second space. The locking plate is at least partially disposed in the third space to secure the locking plate to the input shaft. In particular, a surface of the stepped region may abut a surface of the locking plate to frictionally secure the locking plate within the third space.

In yet another preferred form of this aspect of the present invention, the locking plate comprises an oval snap ring with major and minor axes, flexible in the direction of the minor axis. The input shaft has a surface which defines a recess, the recess being at least partially within the first space. The distance between oppositely facing points on the surface of the input shaft is less than the length of the major axis of the oval snap ring such that the oval snap ring is compressed by the surface of the input shaft along the major axis to frictionally secure the oval snap ring within the recess with the snap ring disposed in the recess.

In yet another preferred form of this aspect of the present invention, the transmission shaft has a bore which extends axially through the transmission shaft, and a fastener is disposed through the bore in the transmission shaft and is secured to the input shaft to hold the male drive region in mateable engagement within the female drive region.

In still another preferred form of the present invention, opposite transmission shaft ends are secured to the drive member and input shaft and oppositely facing radially extending transmission shaft surfaces cooperate with radially extending surfaces on the mateable input shaft and drive member whereby the spacing between said radially extending transmission shaft surfaces are selected to provide a selected spacing of the drive member from the input shaft.

In another aspect of the present invention, an operator for controlling the movement of a window sash relative to a frame is provided, including a base attachable to a frame and having a first support surface; a cover secured to the base and having a second support surface with a hole therethrough defining an internal shoulder, the second support surface mating with the first support surface; a linkage pivotally secured to the base and attachable to a window sash to control the movement of the window sash relative to a frame; a rotatable input shaft driveably engaging the linkage and having a female drive region and an input shaft shoulder formed at a first end thereof, the input shaft disposed with the input shaft shoulder adjacent to the internal shoulder at the first end thereof and the first and second surfaces supporting a second end thereof; a drive member; a transmission shaft secured to the drive member and having a male drive region projecting from he drive member and disposable within and mateable with the input shaft female drive region to transfer the rotation of the transmission shaft to the input shaft; and means for locking the transmission shaft to one of the base and the input shaft to hold the male drive region in mateable engagement within the female drive region.

It is an object of the present invention to provide a window operator for window assemblies which may be easily, efficiently, compactly, and inexpensively stored, shipped, and handled.

It is another object of the present invention to provide a window operator for window assemblies which may be stored, shipped, and handled with virtually no risk of damaging the window assemblies and/or the attached operator.

It is another object of the present invention to provide a window operator which can be easily used in conventional installations, and which may be adapted for use with a variety of drive members.

It is yet another object of the present invention to provide a window operator which may be easily installed and may be easily finally assembled on site after installation of the window to a structure.

It is still another object of the present invention to provide a window operator which is inexpensive and yet of discenably high quality, with the drive member of the operator being securely attached to the operator and being rotatable substantially free of wobble.

BRIEF DESCRIPTION OF THE DRAWINGS

FIG. 9 is a perspective exploded view of a still further window operator according to the present invention;

FIG. 10 is a cross-sectional view of the window operator taken along line 10—10 in FIG. 9;

FIG. 11 is a partial, enlarged cross-sectional view of the part of the locking mechanism shown in FIG. 10;

DESCRIPTION OF THE PREFERRED EMBODIMENTS

Figure 1:
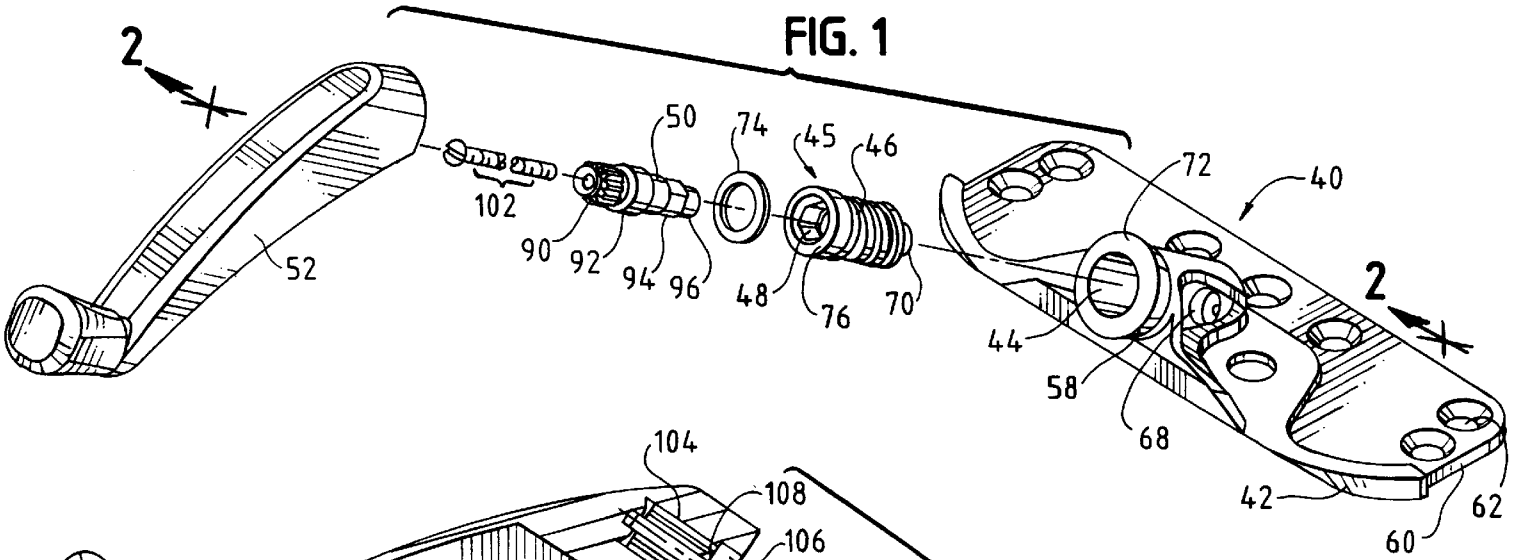
FIG. 1 is a perspective exploded view of a window operator according to the present invention.

Several embodiments of the window operator 40 according to the present invention are shown in FIGS. 1–26, with common elements numbered alike. Common to all embodiments of the window operator 40 are a base 42 defining at least in part a housing 44, a rotatable input shaft 45 with worm or worm-like end 46 supported in the housing 44 (which, because of the worm or worm-like end 46, is also referred to herein as the worm housing 44), a female drive 48 formed in the input shaft 45, a male transmission shaft 50 mateable with the female drive 48 of the input shaft 45, and a handle 52 attached to the male transmission shaft 50. Also common to all embodiments of the window operator 40 is a locking mechanism operable to secure the combination of the male transmission shaft 50 and the handle 52 to the operator 40 with the male transmission shaft 50 disposed in the input shaft 45 and mating with the female drive 48.

Details of these common components may, however, vary as described hereafter and/or shown in the Figures. Further, it should be understood that although a handle 52 is shown with all of the embodiments, any drive member may also be advantageously used with the present invention, including an electric motor drive suitably connected to the male shaft.

With reference to the window operator 40, two operational states can be defined. In a first operational state, the male transmission shaft 50 is not disposed within the female drive 48. In a second operational state, the male transmission shaft 50 is disposed within the female drive 48, and mates with the female drive 48 such that rotation of the handle 52 is transmitted via the male transmission shaft 50 and the female drive 48 to the worm 46. Also in the second operational state, the locking mechanism secures the male transmission shaft 50 to the window operator 40 or input shaft 45 such that the axial forces created when the handle 52 is rotated do not cause the male transmission shaft 50 to separate from the female drive 48. However, if a sufficiently large axial force, much greater than the axial force created by rotating the handle 52, is applied to the handle 52 in an axially outward direction, the locking mechanism allows the male transmission shaft 50 to be withdrawn from the female drive 48, such that the first operational state is achieved.

Comparing FIGS. 1–16 with FIGS. 17–25, it can be seen that the window operator 40 according to the present invention can have with the input shaft 45 and worm 46 mounted centrally on the base 42 (FIGS. 1–16), or offset from the center of the base 42 (FIGS. 17–25). Similarly, the housing 44 may be defined completely by the base 42 (FIGS. 1–16), or the housing 44 may be defined in by the base 42 and a cover 56 such that the input shaft 45 is supported by surfaces on the base 42 and the cover 56 (FIGS. 17–25). Additionally, any manner of gear or gear train can be used to driveably connect the input shaft 45 to a window sash such that the rotation of the input shaft 45 causes the window sash to move between open and closed positions with respect to a window frame. For example, known operator mechanisms or linkages driveable by a worm, such as single arm drives, dual arm drives and dyad drives, may be used with the present invention. Additionally a geared, splined or keyed drive may be disposed between the female drive 48 and the worm 46.

Figure 2:
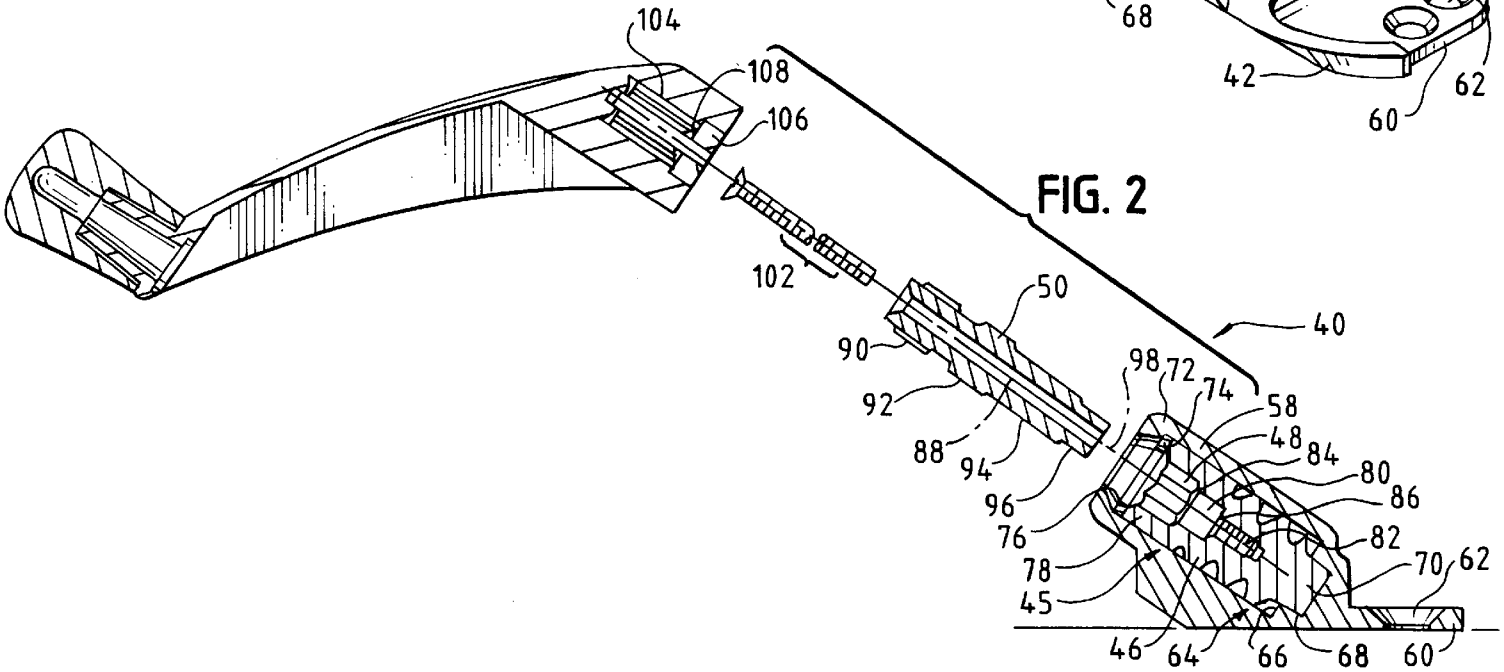
FIG. 2 is a cross-sectional view of the window operator taken along line 2—2 in FIG. 1.

A first embodiment of the window operator 40 is shown in FIGS. 1 and 2. The base 42 has a housing 44 defined by a cylindrical protrusion 58 formed integrally with and extending at an angle from a substantially planar base plate 60. The angular extension is well known in the art to be desirable to allow the handle 52 to be pivoted by a user without interference by the window frame or sash. The base plate 60 has a number of openings 62 formed therethrough so that the base plate 60 may be secured to a window sill and so that gears may be secured to the base plate 60.

The angled, cylindrical protrusion 58 has a first, closed end 64 with an annular shoulder 66 defining a cylindrical receptacle 68 in which a first cylindrical end 70 of the input shaft 45 is disposed. The cylindrical receptacle 68 and the first end 70 of the input shaft 45 cooperate to limit the axial and radial motion of the first end 70 of the input shaft 45.

The angled, cylindrical protrusion 58 also has a second, open end 72 through which the input shaft 45 is disposed. A thrust washer 74 is also disposed through the second, open end 72, and abuts against a shoulder 76 formed at the second end 78 of the input shaft 45. The second, open end 72 is deformed, by swaging, for example, to cooperate with the thrust washer 74 to maintain the worm 46 in a substantially fixed position in the axial direction, with the first end 70 of the input shaft 45 disposed within the cylindrical receptacle 68.

The input shaft 45 has three internal stepped regions formed therein: the female drive region 48, the support region 80 and the tapped locking region 82. The female drive region 48 and the support region 80 are separated by a first internal shoulder 84. The support region 80 and the tapped locking region 82 are separated by a second internal shoulder 86.

The male transmission shaft 50 also has four stepped regions formed on the surface thereof, two of which are mateable with the internal stepped regions of the input shaft 45, and two of which are mateable with internal stepped regions of the handle 52. The four stepped regions of the male shaft 50 include a first splined region 90 (mateable with the handle 52), a second cylindrical spacing region 92 (mateable with the handle 52), a third male drive region 94 (mateable with the input shaft 45), and a fourth support region 96 (mateable with the input shaft 45). In addition, the male transmission shaft 50 has an axial bore 88 formed therethrough.

In the second operational state, the male drive region 94 mates with the internal female drive region 48 to transfer angular motion or rotation of the male shaft 50 to the worm 46. Additionally, the support region 96 mates with the support region 80 of the input shaft 45. The support regions 80, 96 are thought to limit the undesirable wobble, or angular deviation, of the shaft 50 when rotated about the axis 98 of the input shaft 45. To secure the male shaft 50 within the input shaft 45, a locking mechanism is used, including the tapped locking region 82 and a threaded fastener 102. In particular, the threaded fastener 102 is disposed through the bore 88 of the male shaft 50 and cooperates with the tapped locking region 82 of the input shaft 45 to secure the male shaft 50 to the input shaft 45 and to the window operator 40.

Once the threaded fastener 102 has been tightened to secure the male shaft 50 to the input shaft 45, the handle 52 is secured to the male shaft 50. In particular, the handle 52 has a two stepped regions, a splined region 104 and a spacing region 106, separated by a shoulder 108. The splined region 104 mates with the splined region 90 formed on the male shaft 50 and cooperates with the splined region 90 to transmit rotation of the handle 52 to the male shaft 50. Once the splined regions 90, 104 and the spacing regions 92, 106 are mated, the handle 52 may be secured to the shaft 50 using a set screw or some other suitable means of attachment.

Thus assembled in the second operational state, the rotation of the handle 52 causes rotation of the shaft 50 via the cooperation of the splined regions 90, 104. Similarly, rotation of the shaft 50 causes rotation of the worm 46 via the cooperation of the male drive region 94 of the male shaft 50 and the female drive region 48 of the input shaft 45. The removal of the handle 52 and the male shaft 50 and the separation of the male drive region 94 from the female drive region 48 is substantially prevented by the locking mechanism, in particular, the threaded fastener 102 and the tapped locking region 82 of the input shaft 45.

Figure 3:
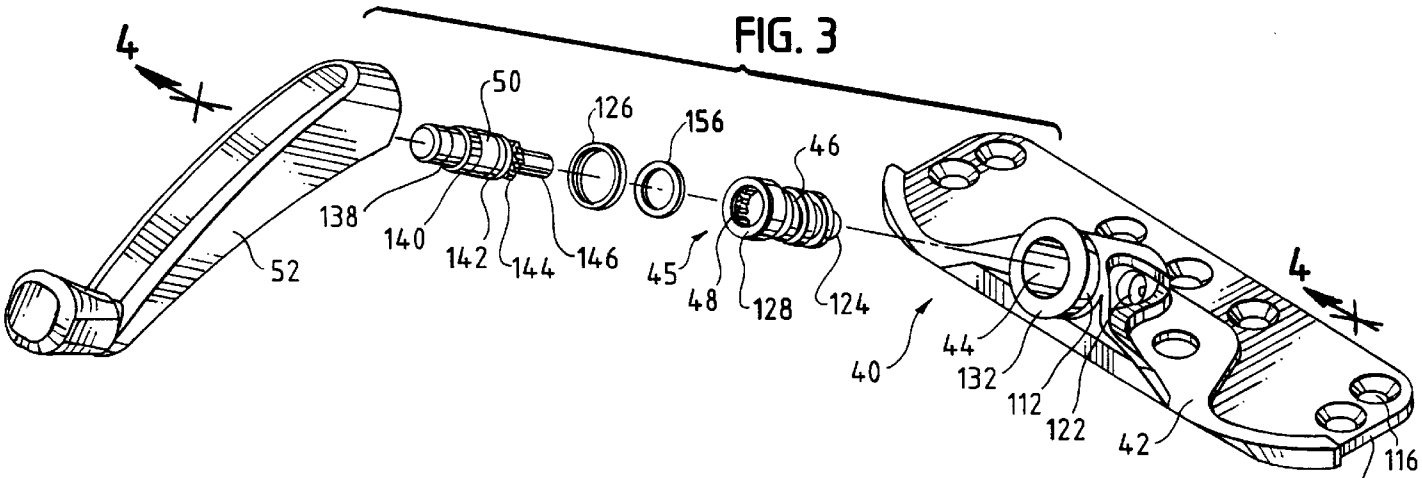
FIG. 3 is a perspective exploded view of another window operator according to the present invention.
Figure 5:
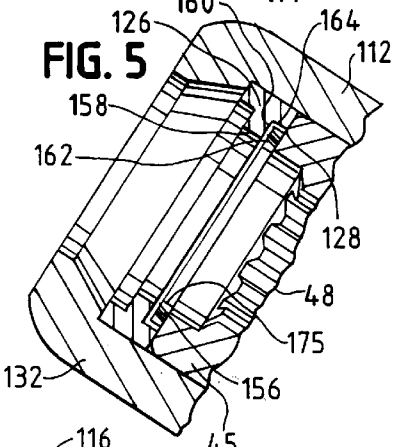
FIG. 5 is a partial, enlarged cross-sectional view of the part of the locking mechanism shown in FIG. 4.
Figure 4:
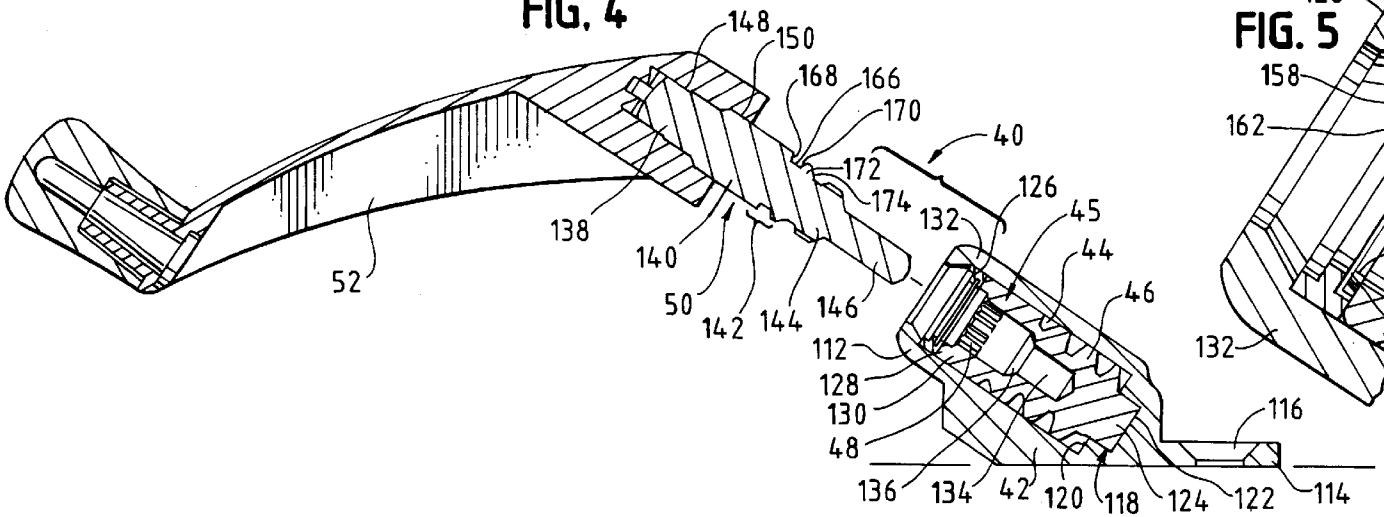
FIG. 4 is a cross-sectional view of the window operator taken along line 4—4 in FIG. 3.

FIGS. 3–5 show another window operator 40 according to the present invention. The base 42 shown in FIGS. 3–5 has the housing 44 defined by a angled, cylindrical protrusion 112 formed integrally with a substantially planar base plate 114 having openings 116 formed therethrough.

The angular cylindrical protrusion 112 has a first closed end 118 with an annular shoulder 120 defining a cylindrical receptacle 122 in which a first cylindrical end 124 of the input shaft 45 is disposed to limit the radial and axial motion of the first cylindrical end 124 of the input shaft 45.

A thrust washer 126 is disposed against or abuts a shoulder 128 defined at the second end 130 of the input shaft 45. A second, open end 132 of the angular cylindrical protrusion 112 is deformed, by swaging, for example, to prevent the axial movement of the worm 46 and to secure the first end 124 of the input shaft 45 within the cylindrical receptacle 122 of the housing 44.

The input shaft 45 has two internal stepped regions formed therein, the female drive region 48 and a support region 134. The female drive region 48 and the support region 134 are separated by an internal shoulder 136.

The male transmission shaft 50 also has five stepped regions: a splined region 138, a cylindrical spacing region 140, a grooved locking region 142, a male drive region 144, and a support region 146. The splined region 138 and the spacing region 140 mate with corresponding splined and spacing regions 148, 150 formed in the handle 52. The handle 52 is permanenty secured to the shaft 50, or alternatively could be releasably secured using a set-screw or some other means of attachment, such as a detent spring, for example.

In the second operational state, the male drive section 144 mates with the female drive section 48 to transfer angular motion or rotation of the male shaft 50 to the worm 46. Additionally, the support region 146 of the male shaft 50 mates with the internal support region 134 of the input shaft 45 to reduce or eliminate undesirable wobble.

To secure the male shaft 50 to the window operator 40 with the male shaft 50 disposed within the input shaft 45 and the male drive region 144 in cooperative engagement with the female drive region 48, a locking mechanism is provided. The locking mechanism includes a locking plate in the form of a snap ring 156 which is an annular washer formed from a resilient, elastically deformable material, such as plastic. Alternatively, the snap ring 156 could be a C-shaped spring made from a resilient, elastically deformable material. The snap ring 156 is loosely seated between the input shaft 45 and the thrust washer 126 (see FIG. 5).

Specifically, the thrust washer 126 is shaped with a central radially inwardly depending extension 158 having an axially inwardly facing shoulder 160. The inwardly facing shoulder 160 and the shoulder 128 define therebetween an annular space 162, in which the snap ring 156 is loosely seated. The axially inwardly facing shoulder 160 and the shoulder 128 limit the axial movement of the snap ring 156, while a radially inwardly facing shoulder 164 of the thrust washer 126 limits the radial movement of the snap ring 156. Alternatively, the annular space 162 may be defined by stepped surfaces of the input shaft 45, rather than the thrust washer 126.

The locking mechanism also includes the grooved locking region 142 of the male shaft 50. In particular, the grooved locking region 142 includes a groove 166 defined by an axially inwardly facing groove shoulder 168 and an axially outwardly facing groove shoulder 170. The axially outwardly facing groove shoulder 170 is defined by one face of a radially outwardly depending extension 172 formed integrally with the male shaft 50. The other face of the radially outwardly depending extension 172 defines an axially inwardly facing shoulder 174

To achieve the second operational state, the male shaft 50 is disposed through the second, open end 132 of the housing 44 and rotated until the male drive region 144 partially engages the female drive region 48 and the axially inwardly facing shoulder 174 comes in contact with the snap ring 156. As axial force is applied in the axially inward direction to the male shaft 50, the axially inwardly facing shoulder 174 causes a radially inwardly extending edge 175 depending from the snap ring 156 to deform, and the radially outwardly depending extension 172 to advance into the input shaft 45. Once the radially outwardly depending extension 172 has advanced such that the groove 166 is aligned with the radially inwardly extending edge 175 of the snap ring 156, the radially inwardly extending edge 175 of the snap ring 156 elastically returns to its original shape. With the radially inwardly extending edge 175 of the snap ring 156 in its original shape, the snap ring 156 is axially confined between the axially inwardly facing groove shoulder 168 in the axially outward direction and the axially outwardly facing groove shoulder 170 in the axially inward direction. As a consequence, the male shaft 50 is secured axially relative to the input shaft 45 such that the male drive region 144 of the male shaft 50 cooperatively engages the female drive region 48. Application of axial force on the handle 52 in the axially outward direction may be used to detach the handle 52 and shaft 50 from the base 42 and input shaft 45.

Figures 6, 7, 8:
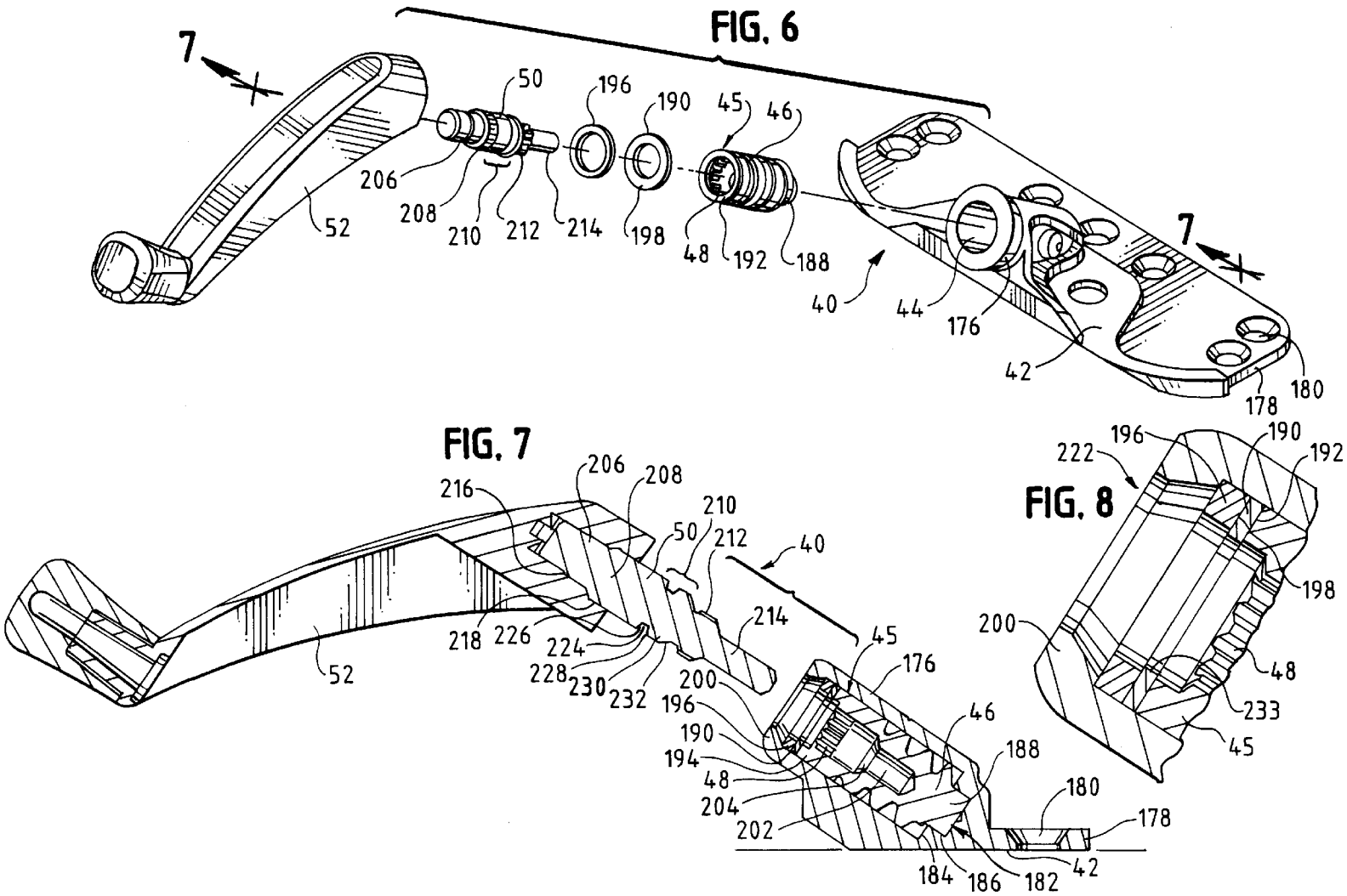
FIG. 6 is a perspective exploded view of a further window operator according to the present invention.
FIG. 7 is a cross-sectional view of the window operator taken along line 7—7 in FIG. 6.
FIG. 8 is a partial, enlarged cross-sectional view of the part of the locking mechanism shown in FIG. 7.

FIGS. 6–8 show another window operator 40 according to the present invention. The base 42 shown in FIGS. 6–8 has the housing 44 defined by a angled cylindrical protrusion 176 formed integrally with a substantially planar base plate 178 having openings 180 formed therethrough.

The angular cylindrical protrusion 176 has a first closed end 182 with an annular shoulder 184 defining a cylindrical receptacle 186 in which a first cylindrical end 188 of the input shaft 45 is disposed to limit the radial and axial motion of the first cylindrical end 188 of the input shaft 45.

A thrust washer 190 is supported on a shoulder 192 defined at the second end 194 of the input shaft 45. A retaining washer 196 is disposed on the axially outwardly facing surface 198 of the thrust washer 190. A second, open end 200 of the angular cylindrical protrusion 176 is deformed, by swaging, for example, to prevent the axial movement of the worm 46 and to secure the first end 188 of the input shaft 45 within the cylindrical receptacle 186 of the housing 44.

The input shaft 45 has two internal stepped regions formed therein, the female drive region 48 and a support region 202. The female drive region 48 and the support region 202 are separated by an internal shoulder 204.

The male transmission shaft 50 also has five stepped regions: a splined region 206, a cylindrical spacing region 208, a grooved locking region 210, a male drive region 212, and a support region 214. The splined region 206 and the spacing region 208 mate with corresponding splined and spacing regions 216, 218 formed in the handle 52. The handle 52 is permanently secured to the shaft 50, or alternatively could be releasably secured using a set-screw or some other means of attachment, such as a detent spring, for example.

In the second operational state, the male drive section 212 mates with the female drive section 48 to transfer angular motion or rotation of the male shaft 50 to the worm 46. Additionally, the support region 214 of the shaft 50 mates with the internal support region 202 of the input shaft 45 to reduce or eliminate undesirable wobble.

To secure the male shaft 50 to the window operator 40 with the male shaft 50 disposed within the input shaft 45 and the male drive region 212 in cooperative engagement with the female drive region 48, a locking mechanism is provided. The locking mechanism includes a locking plate in the form of a the thrust washer 190, which is formed from a resilient, elastically deformable material, such as plastic. The thrust washer 190 is securely disposed between the shoulder 192, the retaining washer 196, and the cylindrical protrusion 176 to substantially prevent the axial and radial movement of the thrust washer 190.

The locking mechanism also includes the grooved locking region 210 of the male shaft 50. In particular, the grooved locking region 210 includes a groove 224 defined by an axially inwardly facing groove shoulder 226 and an axially outwardly facing groove shoulder 228. The axially outwardly facing groove shoulder 226 is defined by one face of a radially outwardly depending extension 230 formed integrally with the male shaft 50. The other face of the radially outwardly depending extension 230 defines an axially inwardly facing shoulder 232.

To achieve the second operational state, the male shaft 50 is disposed through the second, open end 200 of the housing 44 and rotated until the male drive region 212 partially engages the female drive region 48 and the axially inwardly facing shoulder 232 comes in contact with the thrust washer 190. As axial force is applied to the male shaft 50, the axially inwardly facing shoulder 232 causes a radially inwardly extending edge 233 depending from the thrust washer 190 to deform, and the radially outwardly depending extension 230 to advance into the worm 46. Once the radially outwardly depending extension 230 has advanced such that the groove 224 is aligned with the radially inwardly extending edge 233 of the thrust washer 190, the radially inwardly extending edge 233 of the thrust washer 190 elastically returns to its original shape. With the radially inwardly extending edge 233 of the thrust washer 190 in its original shape, the thrust washer 190 is confined by the axially inwardly facing groove shoulder 226 in the axially outward direction and the axially outwardly facing groove shoulder 228 in the axially inward direction. As a consequence, the male shaft 50 is secured axially relative to the input shaft 45 such that the male drive region 212 of the male shaft 50 cooperatively engages the female drive region 48 of the input shaft 45. Application of axial force in the axially outward direction can be used to separate the handle 52 and the shaft 50 from the base 42 and the input shaft 45.

FIGS. 9–11 show a further window operator 40 according to the present invention. The base 42 has the housing 44 defined by a angled cylindrical protrusion 234 formed integrally with a substantially planar base plate 236 having openings 238 formed therethrough.

The angular cylindrical protrusion 234 has a first closed end 240 with a cylindrical shoulder 242 defining a cylindrical receptacle 244 in which a first cylindrical end 246 of the input shaft 45 is disposed to limit the radial and axial motion of the first cylindrical end 246 of the input shaft 45.

A thrust washer 248 is supported on a shoulder 250 defined at the second end 252 of the input shaft 45. A second, open end 254 of the angular cylindrical protrusion 234 is deformed, by swaging, for example, to prevent the axial movement of the worm 46 and to secure the first end 246 of the input shaft 45 within the cylindrical receptacle 244 of the housing 44.

The input shaft 45 has two internal stepped regions formed therein, the female drive region 48 and a support region 256. The female drive region 48 and the support region 256 are separated by an internal shoulder 258.

The male transmission shaft 50 also has five stepped regions: a splined region 260, a cylindrical spacing region 262, a grooved region 264, a male drive region 266, and a support region 268. The splined region 260 and the spacing region 262 mate with corresponding splined and spacing regions 270, 272 formed in the handle 52. The handle 52 is permanently secured to the shaft 50, or alternatively could be releasably secured using a set-screw or some other means of attachment, such as a detent spring, for example.

In the second operational state, the male drive section 266 mates with the female drive section 48 to transfer angular motion or rotation of the male shaft 50 to the worm 46. Additionally, the support region 268 of the male shaft 50 mates with the internal support region 256 of the input shaft 45 to reduce or eliminate undesirable wobble.

To secure the male shaft 50 to the window operator 40 with the male shaft 50 disposed within the input shaft 45 and the male drive region 266 in cooperative engagement with the female drive region 48, a locking mechanism is provided. The locking mechanism includes a locking plate in the form of snap ring 278 formed from a resilient, elastically deformable material. Alternatively, the snap ring 278 can be formed as a C-shaped spring. The snap ring 278 is loosely maintained with the grooved region 264 of the male shaft 50.

In particular, the grooved locking region 264 includes a groove 280 defined by an axially inwardly facing groove shoulder 282 and an axially outwardly facing groove shoulder 284. The snap ring 278 is disposed loosely within the groove 280, and the axially inwardly and outwardly facing groove shoulders 282, 284 limit the axial movement of the snap ring 278 along the male shaft 50.

The locking mechanism also includes the thrust washer 248, which has an inner tapered bore 286 of pentagonal cross-section. The tapered bore 286 has first and second oppositely sloped regions 288, 290, which meet at first and second opposite edges 292, 294 of a central cylindrical surface 296.

To achieve the second operational state, the male shaft 50 is disposed through the second, open end 254 of the housing 44 and rotated until the male drive region 266 partially engages the female drive region 48 and the snap ring 278 comes in contact with the first sloped region 288 of the thrust washer 248. As axial force is applied to the male shaft 50, the first sloped region 288 causes a radially outwardly extending edge 297 of the snap ring 278 to deform radially inwardly. Once the snap ring 278 has advanced such that the radially outwardly extending edge 297 of the snap ring 278 passes across and around the central cylindrical surface 296, the radially outwardly extending edge 297 of the snap ring 278 elastically returns to its original shape in the second sloped region 290. With radially outwardly extending edge 297 of the snap ring 278 in its original shape, the snap ring 278 is confined by the second sloped region 290 in the axially outward direction and by the shoulder 250 in the axially inward direction. As a consequence, the male shaft 50 is secured axially relative to the input shaft 45 such that the male drive region 266 of the male shaft 50 cooperatively engages the female drive region 48 of the input shaft 45. Application of axial force in the outward axial direction to the handle 52 can separate the handle 52 and the male shaft 50 from the base 42 and the input shaft 45.

Figures 12, 13:
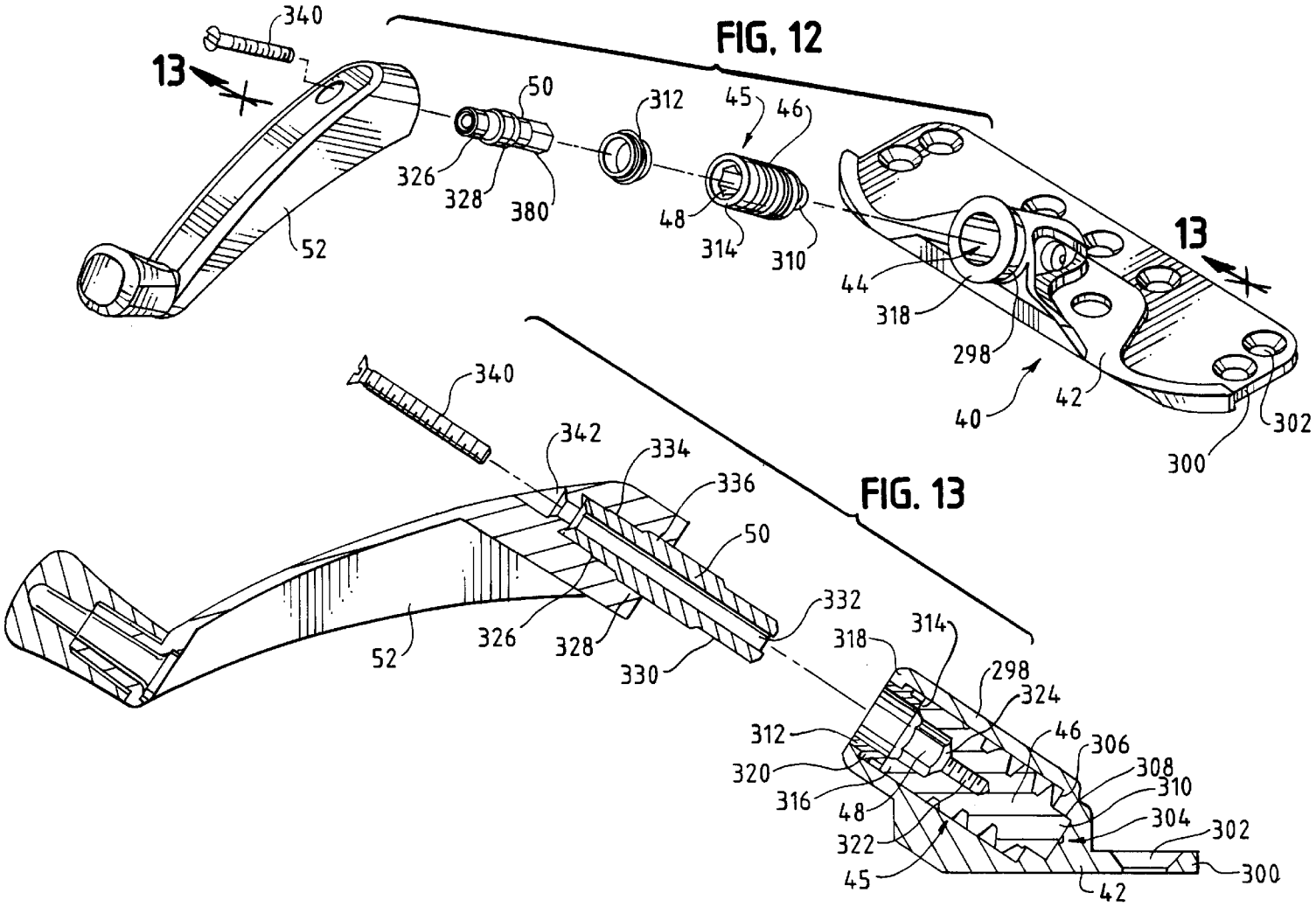
FIG. 12 is a perspective exploded view of another window operator according to the present invention.
FIG. 13 is a cross-sectional view of the window operator taken along line 13—13 in FIG. 12.

FIGS. 12–13 show a still further window operator 40 according to the present invention. The base 42 shown in FIGS. 12–13 has the housing 44 defined by a angled cylindrical protrusion 298 formed integrally with a substantially planar base plate 300 having openings 302 formed therethrough.

The angular cylindrical protrusion 298 has a first closed end 304 with an annular shoulder 306 defining a cylindrical receptacle 308 in which a first cylindrical end 310 of the input shaft 45 is disposed to limit the radial and axial motion of the first cylindrical end 310 of the input shaft 45.

A worm bearing 312 is supported on a shoulder 314 defined at the second end 316 of the input shaft 45. A second, open end 318 of the angular cylindrical protrusion 298 is deformed, by swaging, for example, to prevent the axial movement of the input shaft 45 and to secure the first end 310 of the input shaft 45 within the cylindrical receptacle 308 of the housing 44. In particular, the worm bearing 312 has an integrally formed, radially outwardly depending extension 320 which is formed centrally axially with respect to the ends of the worm bearing 312. The open end 318 is swaged over the radially outwardly depending extension 320 to prevent movement of the worm bearing 312 and the worm 46 in the axial direction.

The input shaft 45 has two internal stepped regions formed therein, the female drive region 48 and a tapped locking region 322. The female drive region 48 and the tapped locking region 322 are separated by an internal shoulder 324.

The male transmission shaft 50 has three stepped regions, a splined region 326, a cylindrical spacing region 328, and a male drive region 330, and a bore 232 formed axially therethrough. The splined region 326 and the spacing region 328 mate with corresponding splined and spacing regions 334, 336 formed in the handle 52.

In the second operational state, the male drive section 330 mates with the female drive section 48 to transfer angular motion or rotation of the male shaft 50 to the worm 46. To secure the male shaft 50 to the window operator 40 with the male shaft 50 disposed within the input shaft 45 and the male drive region 330 in cooperative engagement with the female drive region 48, a locking mechanism is provided.

In particular, the locking mechanism includes a threaded fastener 340 which is passed through an opening 342 in the handle 52 and the bore 332 in the male shaft 50. The threaded fastener 340 is then fastened to the tapped locking region 322 to secure the handle 52 and the male shaft 50 to the input shaft 45. The handle 52 and the male shaft 50 can be separated from the input shaft 45 by unfastening the threaded fastener 340 from the tapped locking region 332.

Figures 14, 15, 16:
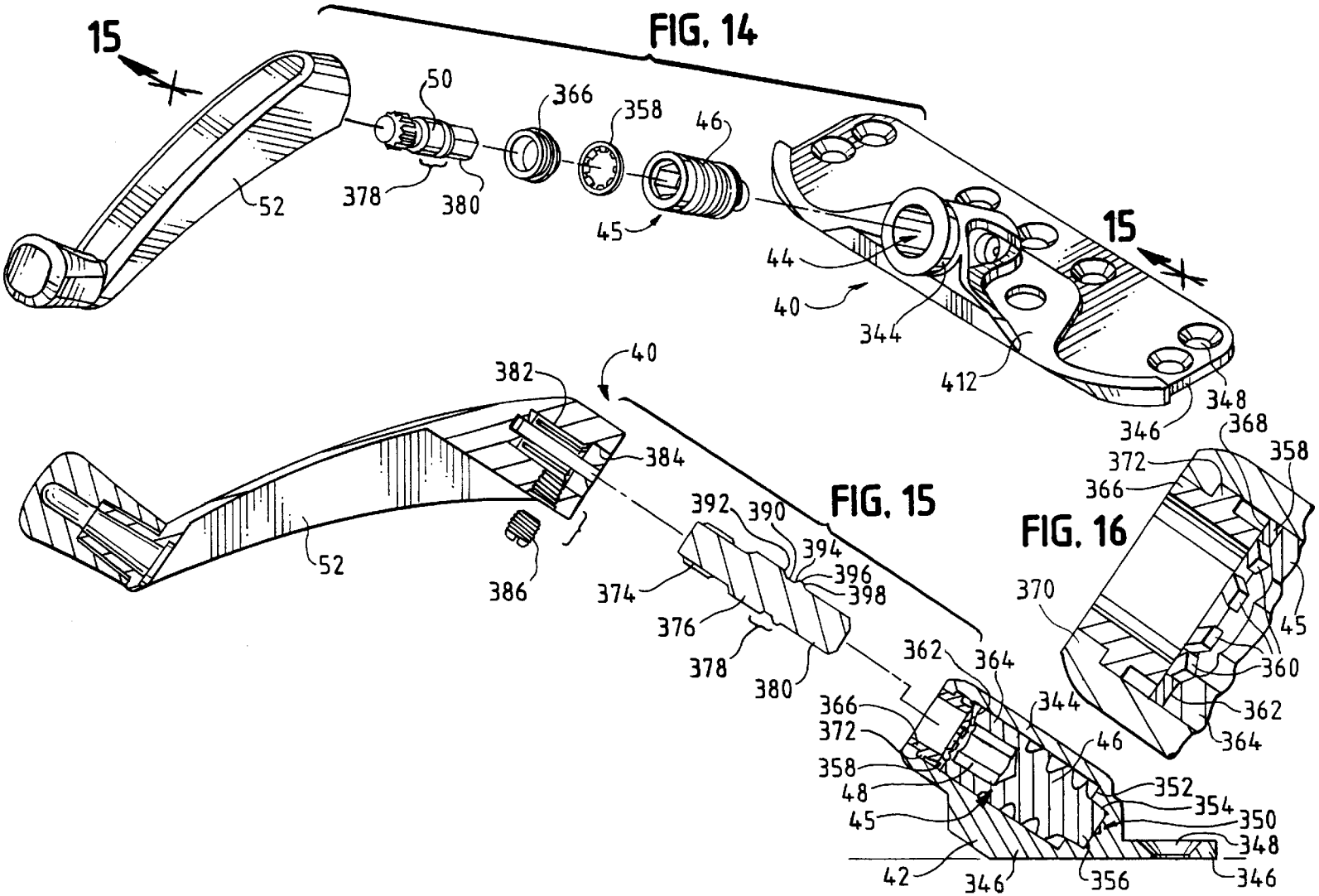
FIG. 14 is a perspective exploded view of a further window operator according to the present invention.
FIG. 15 is a cross-sectional view of the window operator taken along line 15—15 in FIG. 14.
FIG. 16 is a partial, enlarged cross-sectional view of the part of the locking mechanism shown in FIG. 15.

FIGS. 14–16 show a still further window operator 40 according to the present invention. The base 42 shown in FIGS. 14–16 has the housing 44 defined by a angled cylindrical protrusion 344 formed integrally with a substantially planar base plate 346 having openings 348 formed therethrough.

The angular cylindrical protrusion 344 has a first closed end 350 with an annular shoulder 352 defining a cylindrical receptacle 354 in which a first cylindrical end 356 of the input shaft 45 is disposed to limit the radial and axial motion of the first cylindrical end 356 of the input shaft 45.

A retaining ring 358 having a plurality of radially inwardly depending teeth 360 is supported on a shoulder 362 defined at the second end 364 of the input shaft 45. A worm bearing 366 is supported on an axially outwardly facing surface 368 of the retaining ring 358. A second, open end 370 of the angular cylindrical protrusion 344 is deformed, by swaging, for example, to prevent the axial movement of the worm 46 and to secure the first end 356 of the input shaft 45 within the cylindrical receptacle 354 of the housing 44. In particular, the worm bearing 364 has an integrally formed, radially outwardly depending extension 372 which is formed centrally axially with respect to the ends of the worm bearing 364. The open end 370 is swaged over the radially outwardly depending extension 372 to prevent movement of the worm bearing 364 and the worm 46 in the axial direction.

The input shaft 45 has the female drive region 48 formed internally therein. The male transmission shaft 50 has four stepped regions: a splined region 374, a cylindrical spacing region 376, a grooved locking region 378, and a male drive region 380. The splined region 374 and the spacing region 376 mate with corresponding splined and spacing regions 382, 384 formed in the handle 52. The handle 52 is secured to the male shaft 50 using a set screw 386, or some other convention attachment mechanism, such as a detent spring.

In the second operational state, the male drive section 380 mates with the female drive section 48 to transfer angular motion or rotation of the male shaft 50 to the worm 46. To secure the male shaft 50 to the window operator 40 with the male shaft 50 disposed within the input shaft 45 and the male drive region 380 in cooperative engagement with the female drive region 48, a locking mechanism is provided.

The locking mechanism includes a locking plate in the form of the toothed retaining ring 358 mentioned previously. The teeth 360 of the retaining ring 358 fit within the grooved locking region 378 of the male shaft 50, so as to limit the relative axial motion between the shaft male 50 and the input shaft 45. In particular, the grooved locking region 378 includes a groove 390 defined by an axially inwardly facing groove shoulder 392 and an axially outwardly facing groove shoulder 394. The axially outwardly facing groove shoulder 394 is defined by one face of a radially outwardly depending extension 396 formed integrally with the male shaft 50. The other face of the radially outwardly depending extension 396 defines an axially inwardly facing shoulder 398.

To achieve the second operational state, the male shaft 50 is disposed through the second, open end 370 of the housing 44 and rotated until the male drive region 380 partially engages the female drive region 48 and the axially inwardly facing shoulder 398 comes in contact with the teeth 360. As axial force is applied to the male shaft 50, the axially inwardly facing shoulder 398 causes the teeth 360 of the retaining ring 358 to deform radially outward, and the radially outwardly depending extension 396 to advance into the input shaft 45. Once the radially outwardly depending extension 396 has advanced such that the groove 390 is aligned with the teeth 360 of the retaining ring 358, the teeth 360 of the retaining ring 358 elastically return to their original shape. With the teeth 360 of the retaining ring 358 in their original shape, the teeth 360 are confined by the axially inwardly facing groove shoulder 392 in the axially outward direction and the axially outwardly facing groove shoulder 394 in the axially inward direction. As a consequence, the male shaft 50 is permanently secured axially relative to the worm 46 such that the male drive region 380 of the male shaft 50 cooperatively engages the female drive region 48 of the input shaft 45.

Figures 17, 18:
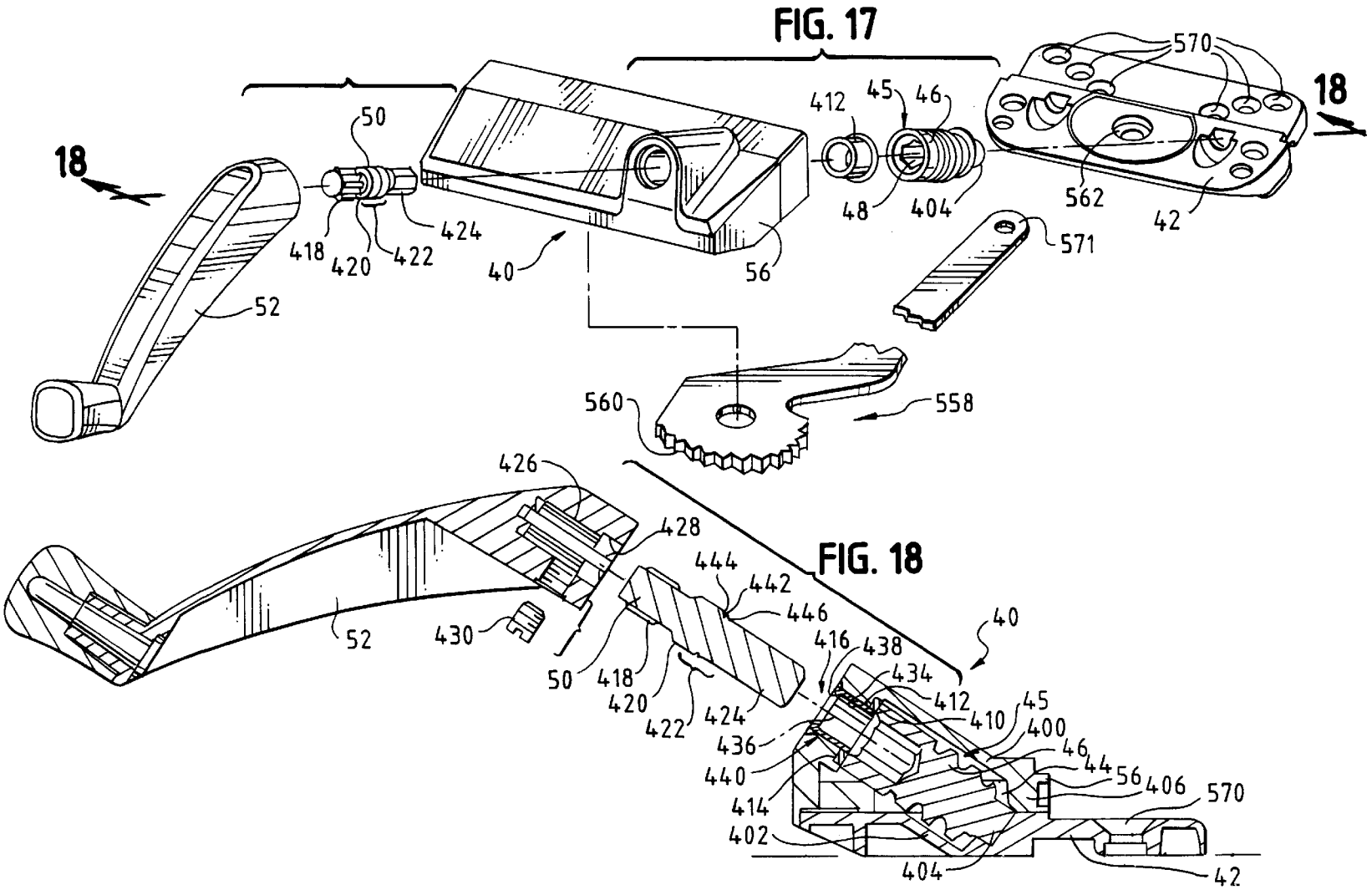
FIG. 17 is a perspective exploded view of a still further window operator according to the present invention.
FIG. 18 is a cross-sectional view of the window operator taken along line 18—18 in FIG. 17.

FIGS. 17–18 show another window operator according to the present invention. The window operator shown in FIGS. 17–18 has the housing 44 define by an angled tubular surface 400 on the cover 56 and an angled tubular worm support surface 402 on the base 42. In particular, the input shaft 45 sits with a first cylindrical end 404 supported by the worm support surface 402 and a vertically downwardly depending stop 406 extending from the cover 56. The second end 408 of the input shaft 45 abuts a thrust washer 410 formed integrally with a retainer 412. The thrust washer 410 abuts an interior shoulder 414 of the cover 56, which interior shoulder 414 defines an opening 416 which extends through the cover 56 and through which the retainer 412 depends. The cooperation of the worm support surface 402 and the stop 406 at the first end 404 of the input shaft 45 and the thrust washer 410 and the interior shoulder 414 at the second end 408 of the input shaft 45 limits the axial motion of the worm 46 relative to the cover 56 and the base 42. The tubular support surface 400 and the worm tubular support surface 402 also cooperate to limit the radial movement of the worm 46.

The input shaft 45 has the female drive region 48 formed therein. The male transmission shaft 50 has four stepped regions: a splined region 418, a spacing region 420, a grooved locking region 422, and a male drive region 424. The splined region 418 and the spacing region 420 mate with the corresponding splined and spacing regions 426, 428 of the handle 52. The handle 52 is secured to the male shaft 50 using a set screw 430 or other suitable attachment mechanism, such as a detent spring.

In the second operational state, the male drive region 424 mates with the female drive region 48 to transfer the angular motion or rotation of the male shaft 50 to the worm 46. To secure the male shaft 50 to the window operator 40 with the male shaft 50 disposed within the input shaft 45 and the male region 424 in cooperative engagement with the female drive region 48, a locking mechanism is provided.

The locking mechanism includes a locking plate in the form of the retainer 412 having a stepped exterior surface 434 which cooperates with the internal shoulder 414 of the cover 56 and the second end 408 of the input shaft 45 to maintain a substantially fixed axial position relative to the cover 56 and the worm 46. The retainer 412 also has a central bore 436 formed therethrough with a radially inwardly extending edge 438 disposed at the axially outwardmost end 440 of the retainer 412.

The radially inwardly extending edge 438 of the retainer 412 fits within the grooved locking region 422 of the male shaft 50, so as to limit axial motion between the shaft 50 and the input shaft 45. In particular, the grooved locking region 422 includes a groove 442 defined by an axially inwardly facing groove shoulder 444 and a radially outwardly extending extension 446.

To achieve the second operational state, the male shaft 50 is disposed through the opening 416 of the cover 56 is rotated until the male drive region 424 partially engages the female drive region 48 and the radially outwardly extending extension 446 comes in contact with the radially inwardly extending edge 438 of the retainer 412. As axial force is applied to the male shaft 50, the radially inwardly extending edge 438 deforms radially outward and the radially outwardly extending extension 446 advances axially. With the groove 442 aligned with the radially inwardly extending edge 438 of the retainer 412, the radially inwardly extending edge 438 returns to its original shape. With the radially inwardly extending edge 438 of the retainer 412 in its original shape, the radially inwardly extending edge 438 is confined by the axially inwardly facing groove shoulder 444 in the axially outward direction and the radially outwardly extending extension 446 in the axially inward direction. As a consequence, the male shaft 50 is secured relative to the input shaft 45 such that the male drive region 424 of the male shaft 50 cooperatively engaged the female drive region 48 of the input shaft 45. Application of an axially outwardly directed force to the handle 52 can separate the handle 52 and the shaft 50 from the input shaft 45, the base 42 and the cover 56.

Figure 19:
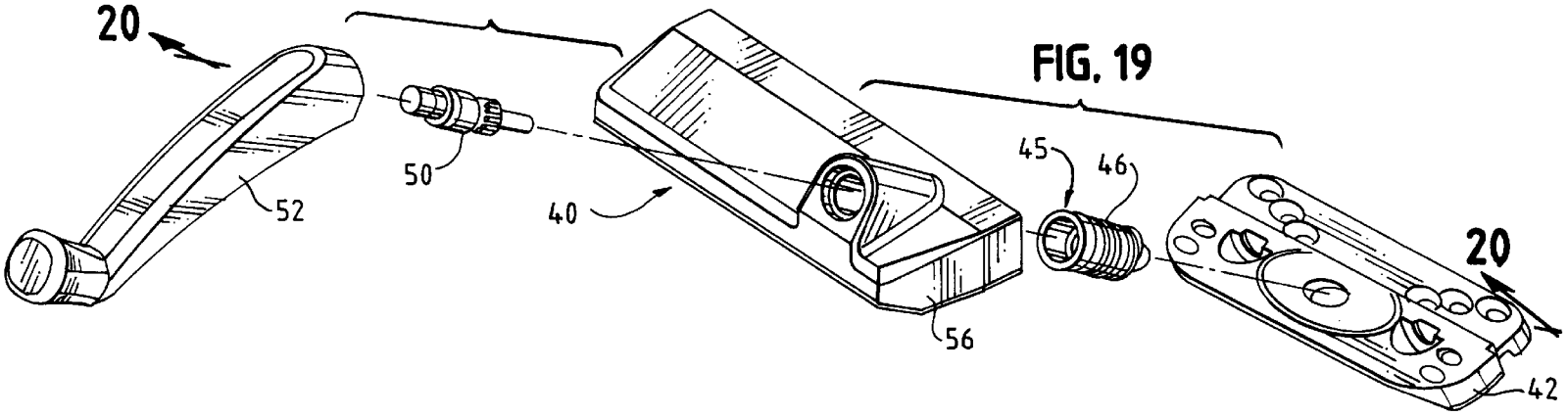
FIG. 19 is a perspective exploded view of another window operator according to the present invention.
Figure 21:
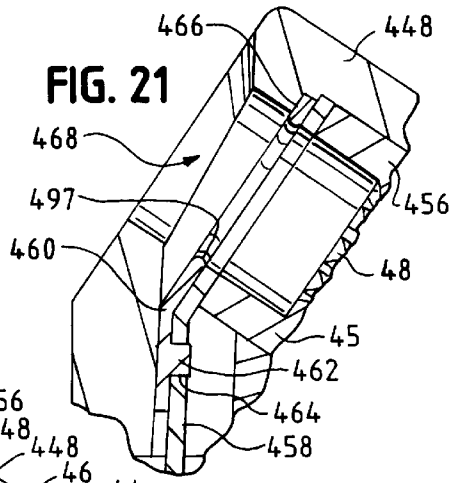
FIG. 21 is a partial, enlarged cross-sectional view of the part of the locking mechanism shown in FIG. 20.
Figure 20:
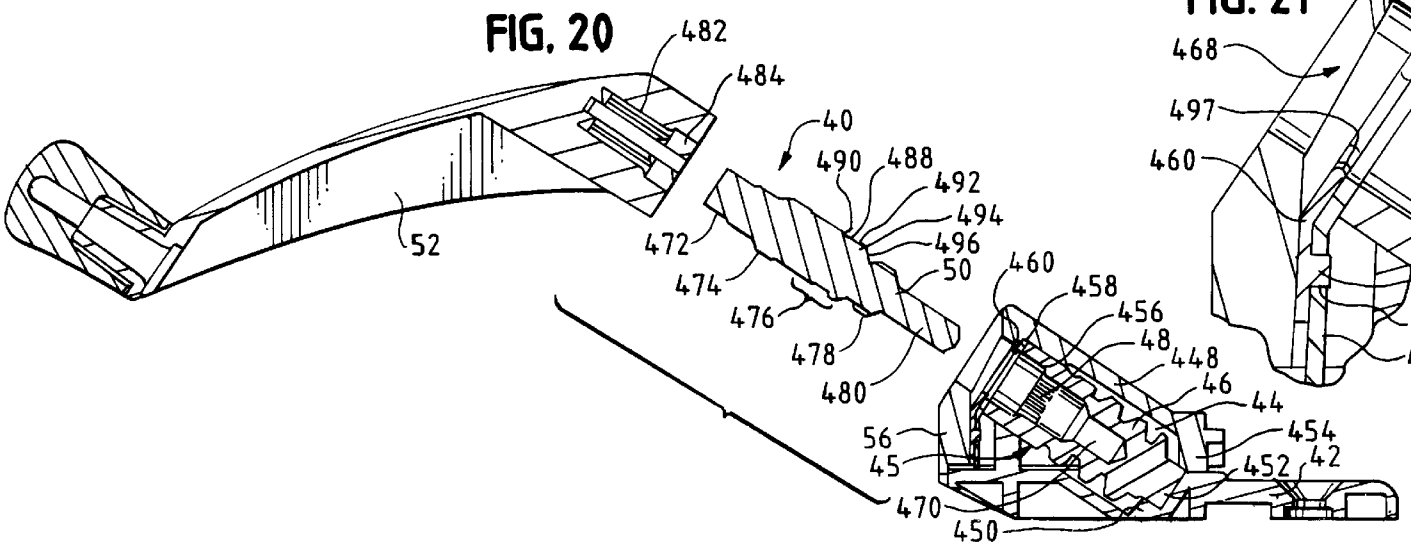
FIG. 20 is a cross-sectional view of the window operator taken along line 20—20 in FIG. 19.
Figures 22, 23, 24, 25:
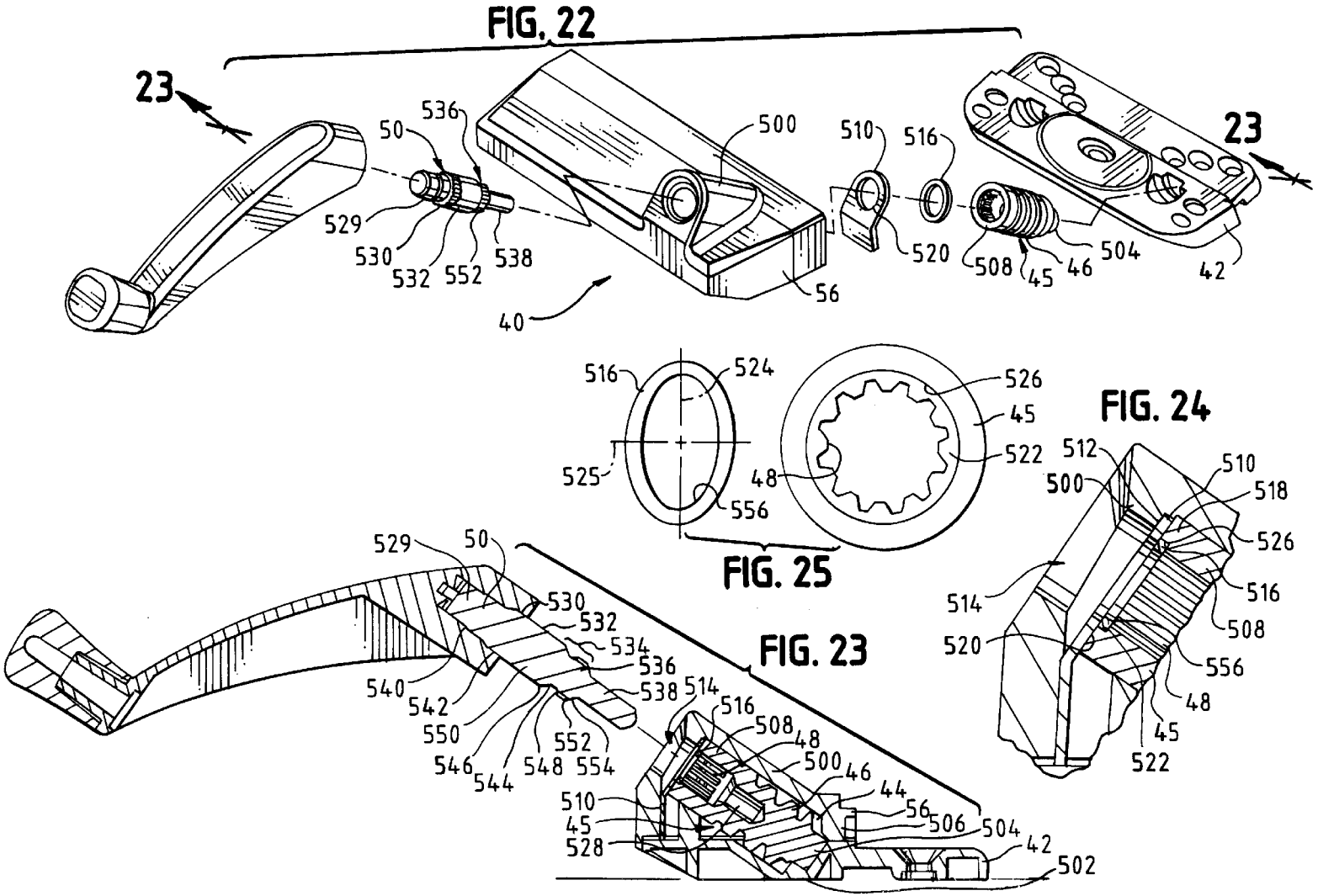
FIG. 22 is a perspective exploded view of still another window operator according to the present invention.
FIG. 23 is a cross-sectional view of the window operator taken along line 23—23 in FIG. 22.
FIG. 24 is a partial, enlarged cross-sectional view of the part of the locking mechanism shown in FIG. 23.
FIG. 25 is an enlarged, frontal view of the locking mechanism shown in FIG. 23.

FIGS. 19–21 show another window operator 40 according to the present invention. The window operator 40 shown in FIGS. 19–21 has the housing 44 defined by an angled tubular surface 448 on the cover 56 and an angled tubular worm support surface 450 on the base 42. In particular, the input shaft 45 sits with a first cylindrical end 452 supported by the worm support surface 450 and a vertically downwardly depending stop 454 extending from the cover 56. The second end 456 of the input shaft 45 abuts a thrust washer 458. The thrust washer 458 abuts a snap ring plate 460, and the snap ring plate 460 is loosely secured to the thrust washer 458 by a button 462 which fits in an aperture 464 in the thrust washer 458. The snap ring plate 460 abuts an interior shoulder 466 of the cover 56, which interior shoulder 466 defines an opening 468 which extends through the cover 56.

The cooperation of the worm support surface 450 and the stop 454 at the first end 452 of the input shaft 45 and the thrust washer 458, snap ring plate 460, and the interior shoulder 466 at the second end 456 of the input shaft 45 limits the axial motion of the worm 46 relative to the cover 56 and the base 42. The tubular support surface 448 and the worm tubular support surface 450 also cooperate to limit the radial movement of the worm 46.

The input shaft 45 has the female drive region 48 and a support region 470 formed therein. The male shaft 50 has five stepped regions: a splined region 472, a spacing region 474, a grooved locking region 476, a male drive region 478, and a support region 480. The splined region 472 and the spacing region 474 mate with the corresponding splined and spacing regions 482, 484 of the handle 52. The handle 52 is permanently secured to the male shaft, or alternatively could be releasably secured using a set screw or other suitable attachment mechanism, such as a detent spring.

In the second operational state, the male drive region 478 mates with the female drive region 48 to transfer the angular motion or rotation of the male shaft 50 to the worm 46. Additionally, the support region 480 of the shaft 50 mates with the internal support region 470 of the input shaft 45 to reduce or eliminate undesirable wobble. To secure the male shaft 50 to the window operator 40 with the male shaft 50 disposed within the input shaft 45 and the male drive region 478 in cooperative engagement with the female drive region 48, a locking mechanism is provided.

The locking mechanism includes a locking plate in the form of the snap ring plate 460 which is formed from a resilient, elastically deformable material, such as plastic. The locking mechanism also includes the grooved locking region 476 of the male shaft 50. In particular, the grooved locking region 476 includes a groove 488 defined by an axially inwardly facing groove shoulder 490 and an axially outwardly facing groove shoulder 492. The axially outwardly facing groove shoulder 492 is defined by one face of a radially outwardly depending extension 494 formed integrally with the male shaft 50. The other face of the radially outwardly depending extension 494 defines an axially inwardly facing shoulder 496.

To achieve the second operational state, the male shaft 50 is disposed through the opening 468 in the cover 56 and rotated until the male drive region 478 partially engages the female drive region 48 of the input shaft 45 and the axially inwardly facing shoulder 496 comes in contact with the snap ring plate 460. As axial force is applied to the male shaft 50, the axially inwardly facing shoulder 496 causes a radially inwardly extending edge 497 of the snap ring plate 460 to deform, and the radially outwardly depending extension 494 to advance into the input shaft 45. Once the radially outwardly depending extension 494 has advanced such that the groove 488 is aligned with the radially inwardly extending edge 497 of the snap ring plate 460, the radially inwardly extending edge 497 of the snap ring plate 460 elastically returns to its original shape. With the radially inwardly extending edge 497 of the snap ring plate 460 in its original shape, the snap ring plate 460 is confined by the axially inwardly facing groove shoulder 490 in the axially outward direction and the axially outwardly facing groove shoulder 492 in the axially inward direction. As a consequence, the male shaft 50 is secured axially relative to the input shaft 45 such that the male drive region 478 of the male shaft 50 cooperatively engages the female drive region 48 of the input shaft 45. Application of axial force on the handle 52 in the axially outward direction may be applied to detach the handle 52 and shaft 50 from the base 42 and input shaft 45.

FIGS. 22–25 show a most preferred window operator 40 according to the present invention. The window operator 40 shown in FIGS. 22–25 has the housing 44 defined by an angled tubular surface 500 on the cover 56 and an angled tubular worm support surface 502 on the base 42. In particular, the input shaft 45 sits with a first cylindrical end 504 supported by the worm support surface 502 and a vertically downwardly depending stop 506 extending from the cover 56. The second end 508 of the input shaft 45 abuts a thrust washer 510. The thrust washer 510, in turn, abuts an interior shoulder 512 of the cover 56, which interior shoulder 512 defines an opening 514 which extends through the cover 56.

The cooperation of the worm support surface 502 and the stop 506 at the first end 504 of the input shaft 45 and the thrust washer 510 and the interior shoulder 512 at the second end 508 of the input shaft 45 limits the axial motion of the worm 46 relative to the cover 56 and the base 42. The tubular support surface 500 and the tubular worm support surface 502 also cooperate to limit the radial movement of the worm 46.

A snap ring 516 is seated in a stepped region 518 of the second end 508 of the input shaft 45. The snap ring 516 abuts an interior surface 520 of the thrust washer 510 and an outwardly facing surface 522 of the stepped region 518 of the input shaft 45 so as to be maintained between the two surfaces 520, 522. Further, the snap ring 516 has an ellipsoidal shape (FIG. 25) with a major axis 524 and a minor axis 525. The snap ring 516 is compressed along the major axis 524 by a radially inwardly facing surface 526 of the stepped region 518 of the input shaft 45 when the snap ring 516 is disposed within the stepped region 518 because the diameter of the surface 526, which is cylindrical in nature, is less than the length of the major axis of the snap ring 516. The flexure of the snap ring 516 causes the snap ring 516 to be frictionally secured within the stepped region 518 of the input shaft 45 so as to maintain the snap ring 516 and input shaft 45 together for assembly purposes, for example.

The input shaft 45 has the female drive region 48 and a support region 528 formed therein. The male transmission shaft 50 has six stepped regions: a first support region 529, a splined region 530, a spacing region 532, a locking region 534, a male drive region 536, and a second support region 538. The first support region 529 and the splined region 530 mate with corresponding shaft support and splined regions 540, 542 of the handle 52. The handle 52 is permanently secured to the male shaft, or alternatively could be releasably secured using a set screw or other suitable attachment mechanism, such as a detent spring.

In the second operational state, the male drive region 536 mates with the female drive region 48 to transfer the angular motion or rotation of the male shaft 50 to the worm 46. Additionally, the second support region 538 of the shaft 50 mates with the internal shaft support region 528 of the input shaft 45 to reduce or eliminate undesirable wobble. To secure the male shaft 50 to the window operator 40 with the male shaft 50 disposed within the input shaft 45 and the male drive region 536 in cooperative engagement with the female drive region 48, a locking mechanism is provided.

The locking mechanism includes a locking plate in the form of the snap ring 516 which is formed from a resilient, elastically deformable material, such as plastic. The locking mechanism also includes the locking region 534 of the male shaft 50. In particular, the locking region 534 includes a groove 544 defined by an axially inwardly facing groove shoulder 546 and an axially outwardly facing groove shoulder 548. The axially inwardly facing groove shoulder 546 is defined by one face of a radially outwardly depending extension 550 formed integrally with the male shaft 50. The axially outwardly facing groove shoulder 548 is defined by a surface of the male drive region 536. Particularly, where the male drive region 536 has a splined or toothed section 552, as shown, the axially outwardly facing groove shoulder 548 is defined by an end of the splines or teeth.

To achieve the second operational state, the male shaft 50 is disposed through the opening 514 in the cover 56 until an axially inwardly facing shoulder 554 of the drive region 536 comes in contact with the snap ring 516. As axial force is applied to the male shaft 50, the axially inwardly facing shoulder 554 causes a radially inwardly extending edge 556 of the snap ring 516 to deform, and the male drive region 536 to advance into the input shaft 45. Once the male drive region 536 has advanced such that the groove 544 is aligned with the radially inwardly extending edge 556 of the snap ring 516, the radially inwardly extending edge 556 of the snap ring 516 elastically returns to its previous elliptical shape. With the to radially inwardly extending edge 556 of the snap ring 516 in its previous shape, opposed sides of the snap ring 516 (on the minor axis of the elliptical shape) are confined by the axially inwardly facing groove shoulder 546 in the axially outward direction and the axially outwardly facing groove shoulder 548 in the axially inward direction. As a consequence, the male shaft 50 is secured axially relative to the input shaft 45 such that the male drive region 536 of the male shaft 50 cooperatively engages the female drive region 48 of the input shaft 45. The taper of shoulder 548 will, however, allow the handle 52 and shaft 50 to be detached from the base 42 and input shaft 45 by application of a force in the axially outward direction.

It will be recognized by one of ordinary skill in the art that any of the window operators 40 discussed herein would have an operating arm associated therewith, the worm 46 driveably engaging the operating arm with the operator 40 in the second operational state, so as to control the movement of a window sash relative to a window frame. In FIG. 17, for example, an operating arm 558 is shown, which arm 558 has a first geared end 560 which engages the worm 46. The arm 558 is pivotally secured to a post (not shown) which depends from the cover 56 and fits into an opening 562 in the base 42. The arm 558 is spaced from the cover 56 by a bushing (not shown). While the single arm 558 with a geared end 560 is shown in FIG. 17, alternatively the worm 46 may mesh with one or more gears, which gears may be secured to one or more arms, such as in the window operator shown in U.S. Pat. No. 5,272,837 or still other driveable connections for controlling operation of a window sash.

Figure 26:
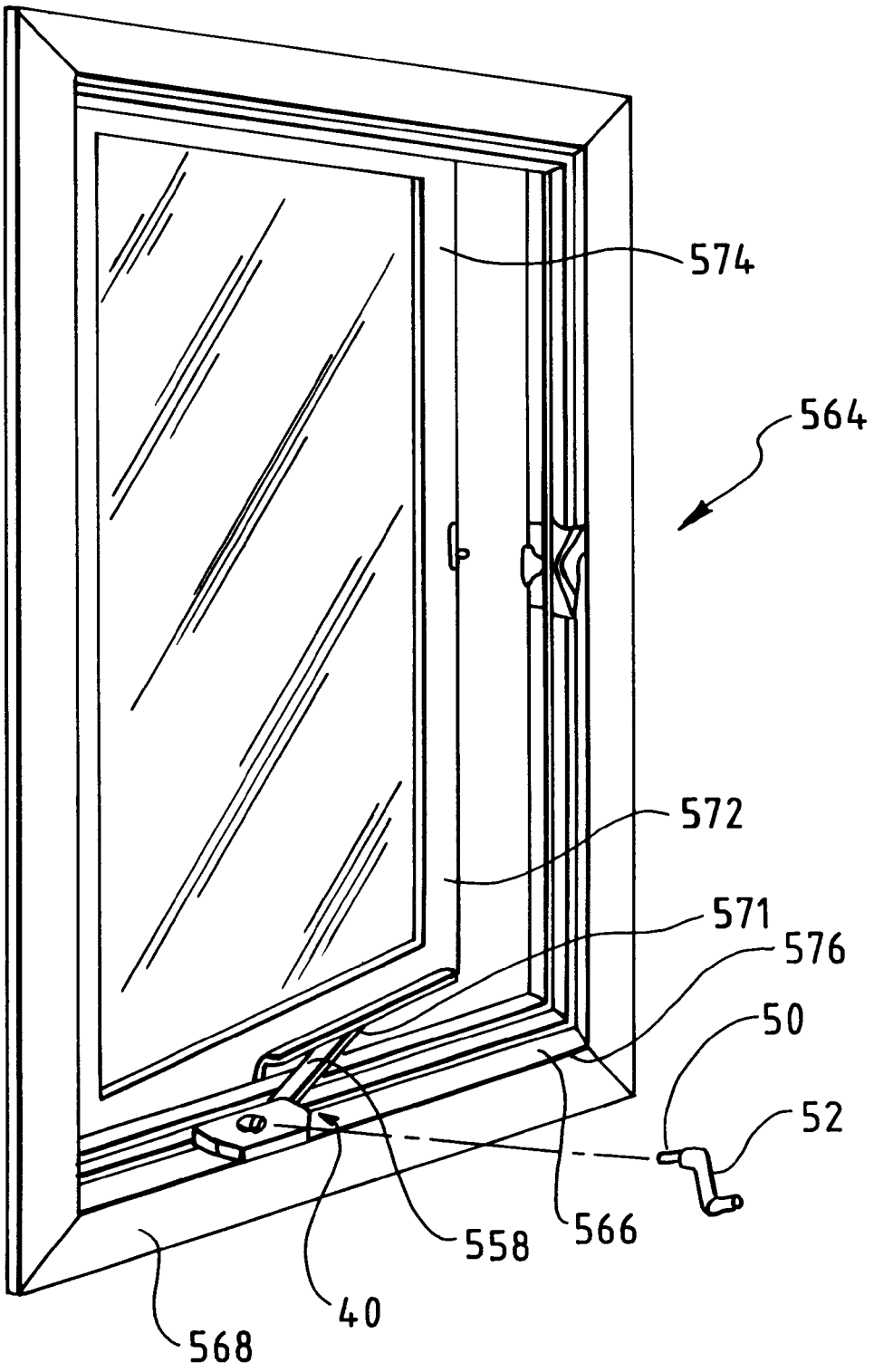
FIG. 26 is a perspective view of a window into which a window operator according to the present invention has been installed.

As shown in FIG. 26, a window assembly 564 may be formed by securing the base 42 of the window operator 40, such as the window operator 40 shown in FIGS. 17–18, to a sill 566 of a frame 568 using a suitable fastening means, such as threaded fasteners or screws, through suitable openings provided in the base 42 (such as openings 570 shown in the FIGS. 17–18 embodiment). An end 571 of the arm 558 is secured to a rail 572 of a window sash 574. As shown in FIG. 26, the operator 40 is in the first operational state, i.e., the handle 52 and the shaft 50 are not disposed within the female drive region 48 of the input shaft 45. In this first operational state, no portion of the window operator 40 extends beyond the edge 576 of the sill 566.

The window operator according to the present invention thus presents no protruding shaft or handle which would make packaging and shipping window assemblies using the window operator difficult or expensive. Additionally, the step of attaching the shaft and handle to the window operator can be deferred during installation until the window assembly is actually secured to a building. This prevents the windows from being damaged by the protruding shafts and handles of other window assemblies, and also allows the window assemblies to be stacked more closely to conserve space on the work site during installation. Further, by deferring the step of installing the shaft and handle until after the window assembly is installed, damage to the window operator during the installation of the window assembly or installation of the window operator to the window is reduced or avoided altogether. Still further, by providing selected dimensions for the male shaft, and particularly a selected spacing between oppositely facing radially extending shaft surfaces as shown with the described embodiments, a precise spacing may be provided between the handle and the base/housing so as to ensure a proper look (without a large gap between the housing and handle base) while also ensuring proper operation (without the handle rubbing against the housing during operation).

Still other aspects, objects and advantages of the present invention can be obtained from a study of the specification, the drawings and the appended claims.

We claim:

1. An operator for controlling the movement of a window sash relative to a frame, the operator comprising:

a base attachable to a frame;

a linkage secured to the base and attachable to a window sash to control the movement of the window sash relative to a frame;

an axially extending rotatable input shaft rotatably secured to the base and having a threaded portion driveably engaging the linkage, the input shaft having a hollow female drive region formed therein which axially overlaps with said threaded portion;

a drive member;

a transmission shaft secured on one end to the drive member and having a male drive region disposable within and mateable with the input shaft female drive region to transfer rotation of the transmission shaft to the input shaft; and means for locking the transmission shaft to one of the base and the input shaft to hold the male drive region in mateable engagement with the female drive region.

2. The operator according to claim 1, wherein the input shaft threaded portion is a worm which directly driveably engages the linkage.

3. The operator according to claim 1, wherein the transmission shaft has a support region extending axially from the male drive region and the input shaft has a support region which extends axially into the input shaft from the female drive region, the support region of the transmission shaft being disposed within the support region of the input shaft with the male drive region of the transmission shaft disposed in and in mateable engagement with the female drive region of the input shaft.

4. The operator according to claim 1, wherein:

the transmission shaft has a bore which extends axially through the transmission shaft; and the means for locking the transmission shaft to one of the base and the input shaft comprises a fastener which is disposed through the bore in the transmission shaft and is secured to the input shaft to hold the male drive region in mateable engagement within the female drive region.

5. The operator according to claim 1, wherein the transmission shaft is secured to the drive member to translate angular rotation of the drive member to the transmission shaft.

6. The operator according to claim 1, further comprising means for locking the transmission shaft to the drive member to translate angular rotation of the drive member to the transmission shaft.

7. The operator according to claim 1, wherein the transmission shaft end opposite said transmission shaft one end is securable to the input shaft, and further comprising oppositely facing radially extending transmission shaft surfaces facing said transmission shaft ends and radially extending surfaces on said mateable input shaft and drive member cooperating with said transmission shaft surfaces whereby the spacing between said radially extending transmission shaft surfaces are selected to provide a selected spacing of said drive member from said input shaft.

8. The operator according to claim 1, wherein the drive member is a manually engageable handle.

9. The operator according to claim 1, wherein the transmission shaft end opposite said transmission shaft one end protrudes from the drive member.

10. An operator for controlling the movement of a window sash relative to a frame, said operator comprising:

a base attachable to a frame and having a first support surface;

a cover secured to said base and having a second support surface with a hole therethrough defining an internal shoulder, the second support surface mating with the first support surface;

a linkage secured to said base and attachable to a window sash to control the movement of the window sash relative to a frame;

an axially extending rotatable input shaft having a threaded portion driveably engaging said linkage and having a hollow female drive region and an input shaft shoulder formed at a first end thereof, said female drive region axially overlapping with said threaded portion and said input shaft disposed with the input shaft shoulder adjacent to the internal shoulder at the first end thereof and the first and second surfaces supporting a second end thereof;

a drive member;

a transmission shaft secured to the drive member and having a male drive region projecting from the drive member and disposable within and mateable with the input shaft female drive region to transfer the rotation of the transmission shaft to the input shaft; and means for locking the transmission shaft to one of the base and the input shaft to hold the male drive region in mateable engagement within the female drive region.

11. The operator according to claim 10, wherein the input shaft threaded portion is a worm which directly driveably engages the linkage.

12. The operator according to claim 10, wherein the cover and the input shaft cooperate to define a first space in which at least part of the means for locking the transmission shaft to one of the base and the input shaft is disposed to secure the means for locking the transmission shaft to one of the base and the input shaft to the base.

13. The operator according to claim 10, wherein the drive member is a manually engageable handle.

14. The operator according to claim 10, wherein the transmission shaft is a male shaft having one end mateable with the input shaft and the end opposite said one end mateable with the drive member, and further comprising oppositely facing radially extending transmission shaft surfaces facing said transmission shaft ends and radially extending surfaces on said mateable input shaft and drive member cooperating with said transmission shaft surfaces whereby the spacing between said radially extending transmission shaft surfaces are selected to provide a selected spacing of said drive member from said input shaft.

15. An operator for controlling the movement of a window sash relative to a frame, the operator comprising:

a base attachable to a frame;

a linkage secured to the base and attachable to a window sash to control the movement of the window sash relative to a frame;

a rotatable input shaft rotatable secured to the base and driveably engaging the linkage, the input shaft having a female drive region formed therein;

a drive member;

a transmission shaft secured on one end to the drive member and having a male drive region disposable within and mateable with the input shaft female drive region to transfer rotation of the transmission shaft to the input shaft; and means for locking the transmission shaft to one of the base and the input shaft to hold the male drive region in mateable engagement with the female drive region including a locking plate secured to one of the base and the input shaft, one of the transmission shaft and the locking plate having a groove formed therein, and the other of the transmission shaft and the locking plate having a radially extending edge depending therefrom, the radially extending edge disposed within the groove to secure the transmission shaft to the base with the male drive region in mateable engagement within the female drive region.

16. The operator according to claim 15, wherein the radially extending edge depends from the locking plate and is defined by a plurality of protrusions extending from the locking plate, the protrusions disposed within the groove in the transmission shaft to secure the transmission shaft to the base with the male drive region in mateable engagement within the female drive region.

17. The operator according to claim 15, further comprising a snap ring secured to the transmission shaft, the snap ring defining the radially extending edge depending from the transmission shaft.

18. The operator according to claim 15, wherein the radially extending edge is formed of an elastically deformable material.

19. The operator according to claim 15, wherein the base and the input shaft cooperate to define a first space in which the locking plate is at least partially disposed to secure the locking plate to one of the base and the input shaft.

20. The operator according to claim 19, further comprising a washer at least partially disposed in the first space to secure said washer to the base and cooperating with the base to define a second space in which the locking plate is at least partially disposed to secure the locking plate to the base.

21. The operator according to claim 19, further comprising a washer at least partially disposed in the first space to secure said washer to the base and cooperating with the input shaft to define a second space in which the locking plate is at least partially disposed to secure the locking plate to the input shaft.

22. The operator according to claim 21, wherein the input shaft has a stepped region which defines a third space, the third space being at least partially within the second space and the locking plate being at least partially disposed in the third space to secure the locking plate to the input shaft.

23. The operator according to claim 22, wherein the stepped region has a surface which defines the third space, and the locking plate has a surface which abuts the surface of the stepped region so as to frictionally secure the locking plate within the third space.

24. The operator according to claim 19, wherein:

the locking plate comprises an oval snap ring with major and minor axes, flexible in the direction of the minor axis;

the input shaft has a surface which defines a recess, the recess being at least partially within the first space, and the distance between oppositely facing points on the surface of the input shaft is less than the length of the major axis of the oval snap ring such that the oval snap ring is compressed by the surface of the input shaft along the major axis to frictionally secure the oval snap ring within the recess with the snap ring disposed in the recess.

* * * * *